US011575202B2

(12) United States Patent
Hayes et al.

(10) Patent No.: US 11,575,202 B2
(45) Date of Patent: Feb. 7, 2023

(54) MONOPOLE ANTENNA ASSEMBLY WITH DIRECTIVE-REFLECTIVE CONTROL

(71) Applicant: SMARTSKY NETWORKS LLC, Morrisville, NC (US)

(72) Inventors: Gerard James Hayes, Wake Forest, NC (US); Koichiro Takamizawa, Silver Spring, MD (US); James O. Legvold, Willow Park, TX (US); Elbert Stanford Eskridge, Jr., Chapel Hil, NC (US); Mike Barts, Raleigh, NC (US); John Swartz, Durham, NC (US)

(73) Assignee: SMARTSKY NETWORKS LLC, Morrisville, NC (US)

( * ) Notice: Subject to any disclaimer, the term of this patent is extended or adjusted under 35 U.S.C. 154(b) by 0 days.

(21) Appl. No.: 17/297,047

(22) PCT Filed: Nov. 22, 2019

(86) PCT No.: PCT/US2019/062804
§ 371 (c)(1),
(2) Date: May 26, 2021

(87) PCT Pub. No.: WO2020/171864
PCT Pub. Date: Aug. 27, 2020

(65) Prior Publication Data

US 2022/0029291 A1 Jan. 27, 2022

Related U.S. Application Data

(60) Provisional application No. 62/773,031, filed on Nov. 29, 2018.

(51) Int. Cl.
*H01Q 3/44* (2006.01)
*H01Q 1/28* (2006.01)
(Continued)

(52) U.S. Cl.
CPC ..... *H01Q 3/446* (2013.01); *H01Q 1/28* (2013.01); *H01Q 1/282* (2013.01); *H01Q 1/287* (2013.01);
(Continued)

(58) Field of Classification Search
CPC ..... H01Q 3/446; H01Q 1/282; H01Q 1/287; H01Q 9/34; H01Q 19/32; H01Q 21/205; H01Q 1/286; H01Q 1/28
See application file for complete search history.

(56) References Cited

U.S. PATENT DOCUMENTS 3,846,799 A * 11/1974 Gueguen ..... G01S 1/02 343/837
4,700,197 A 10/1987 Milne
5,293,172 A 3/1994 Lamberty et al.
(Continued)

FOREIGN PATENT DOCUMENTS

WO 2013089731 A1 6/2013

OTHER PUBLICATIONS

International Search Report and Written Opinion of International Application No. PCT/US2019/062804 dated Sep. 18, 2020, all enclosed pages cited.

*Primary Examiner* — Andrea Lindgren Baltzell
*Assistant Examiner* — Yonchan J Kim
(74) *Attorney, Agent, or Firm* — Burr & Forman, LLP

(57) ABSTRACT

An antenna assembly includes a driven element, a first set of antenna elements disposed a first distance from the driven element such that each element of the first set of antenna elements is equidistant from adjacent elements of the first set of antenna elements, and a second set of antenna elements disposed a second distance from the driven element such that each element of the second set of antenna elements is equidistant from adjacent elements of the second set of antenna elements, the second distance being larger than the
(Continued)

first distance. The antenna assembly includes or is operably coupled to a selector module configured to select one element of the first set of antenna elements as a selected director, and select one element of the second set of antenna elements as a selected reflector by effectively shortening a length of the selected director and effectively lengthening the selected reflector.

20 Claims, 7 Drawing Sheets

(51) Int. Cl.
*H01Q 9/34* (2006.01)
*H01Q 19/32* (2006.01)
*H01Q 21/20* (2006.01)

(52) U.S. Cl.
CPC ..... *H01Q 9/34* (2013.01); *H01Q 19/32* (2013.01); *H01Q 21/205* (2013.01)

(56) References Cited

U.S. PATENT DOCUMENTS

| | | | | |
|---|---|---|---|---|
| 8,514,130 | B1 * | 8/2013 | Jensen | H01Q 19/32 342/367 |
| 8,744,360 | B2 | 6/2014 | Zheng | |
| 2004/0027304 | A1 * | 2/2004 | Chiang | H01Q 3/446 343/810 |
| 2005/0052330 | A1 * | 3/2005 | Mehltretter | H01Q 1/287 343/705 |
| 2008/0122728 | A1 | 5/2008 | Philippakis | |
| 2010/0124210 | A1 | 5/2010 | Lo | |
| 2015/0325907 | A1 * | 11/2015 | Goetz | H01Q 21/28 343/713 |

* cited by examiner

MONOPOLE ANTENNA ASSEMBLY WITH DIRECTIVE-REFLECTIVE CONTROL

CROSS REFERENCE TO RELATED APPLICATIONS

This application claims priority to U.S. application No. 62/773,031 filed Nov. 29, 2018, the entire contents of which are hereby incorporated by reference in its entirety.

TECHNICAL FIELD

Example embodiments generally relate to wireless communications and, more particularly, relate to an antenna assembly configured to enable directivity over 360 degrees around the antenna assembly.

BACKGROUND

High speed data communications and the devices that enable such communications have become ubiquitous in modern society. These devices make many users capable of maintaining nearly continuous connectivity to the Internet and other communication networks. Although these high speed data connections are available through telephone lines, cable modems or other such devices that have a physical wired connection, wireless connections have revolutionized our ability to stay connected without sacrificing mobility.

However, in spite of the familiarity that people have with remaining continuously connected to networks while on the ground, people generally understand that easy and/or cheap connectivity will tend to stop once an aircraft is boarded. Aviation platforms have still not become easily and cheaply connected to communication networks, at least for the passengers onboard. Attempts to stay connected in the air are typically costly and have bandwidth limitations or high latency problems. Moreover, passengers willing to deal with the expense and issues presented by aircraft communication capabilities are often limited to very specific communication modes that are supported by the rigid communication architecture provided on the aircraft.

As improvements are made to network infrastructures to enable better communications with in-flight receiving devices of various kinds, one area in which improvement may be possible is the airborne antenna. Due to limitations created by size and weight, as well as the rigors of certification requirements, a typical aviation antenna includes a flush-mounted (e.g. cavity, patch, and slot) element or an above-surface (e.g. monopole and dipole) configuration. In order to reduce or minimize aerial resistance (drag), a low mechanical form factor is also generally desirable. Accordingly, above-surface antennas are typically designed to provide a relatively broad area of coverage with a relatively low-gain. Thus, above-surface antennas are frequently constructed using ¼-wave, vertically-polarized monopole antennas or elevated horizontally-polarized dipoles. However, as the demand for improved performance of wireless communications with aviation platforms increases, the legacy designs for aviation antennas will also require improvement.

BRIEF SUMMARY OF SOME EXAMPLES

Some example embodiments may therefore provide antenna configurations that deliver improved characteristics which, when translated into network usage, may improve network performance so that air-to-ground (ATG) networks can perform at expected levels within reasonable cost structures. In some embodiments, an omni-directional antenna configuration may be provided that can be employed in connection with directive and/or reflective elements to increase gain without significantly increasing size, weight or cost. The fact that the resulting antenna is directive allows beam steering that can improve interference reduction and also minimize overall network costs by enabling ground stations to be spaced farther apart. Accordingly, for example, signal coverage may be improved with relatively low cost equipment since fewer base stations may be needed to accommodate antennas that are omni-directional, but steerable with a relatively high gain.

In one example embodiment, an antenna assembly is provided. The antenna assembly may include a driven element, a first set of antenna elements disposed a first distance from the driven element such that each element of the first set of antenna elements is equidistant from adjacent elements of the first set of antenna elements, and a second set of antenna elements disposed a second distance from the driven element such that each element of the second set of antenna elements is equidistant from adjacent elements of the second set of antenna elements. The second distance may be larger than the first distance. The antenna assembly may include or be operably coupled to a selector module configured to select one element of the first set of antenna elements as a selected director, and select one element of the second set of antenna elements as a selected reflector by effectively shortening a length of the selected director and effectively lengthening the selected reflector.

In another example embodiment, a selector module for control of an antenna assembly is provided. The antenna assembly may include a driven element, a first set of antenna elements disposed a first distance from the driven element such that each element of the first set of antenna elements is equidistant from adjacent elements of the first set of antenna elements, and a second set of antenna elements disposed a second distance from the driven element such that each element of the second set of antenna elements is equidistant from adjacent elements of the second set of antenna elements. The second distance may be larger than the first distance. The selector module may include a first switch assembly operably coupled to the first set of antenna elements to select one element of the first set of antenna elements as a selected director and to effectively shortening a length of the selected director, and a second switch assembly operably coupled to the second set of antenna elements to select one element of the second set of antenna elements as a selected reflector and to effectively lengthen the selected reflector.

In yet another example embodiment, a method of forming a directive beam may be provided. The method may include receiving information indicative of a relative location between an in-flight aircraft and a base station. The method may further include operating a selector module to select individual elements from among concentric sets of antenna elements of an antenna assembly as parasitic elements to form a directive beam from the antenna assembly of the aircraft to the base station based on the information.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
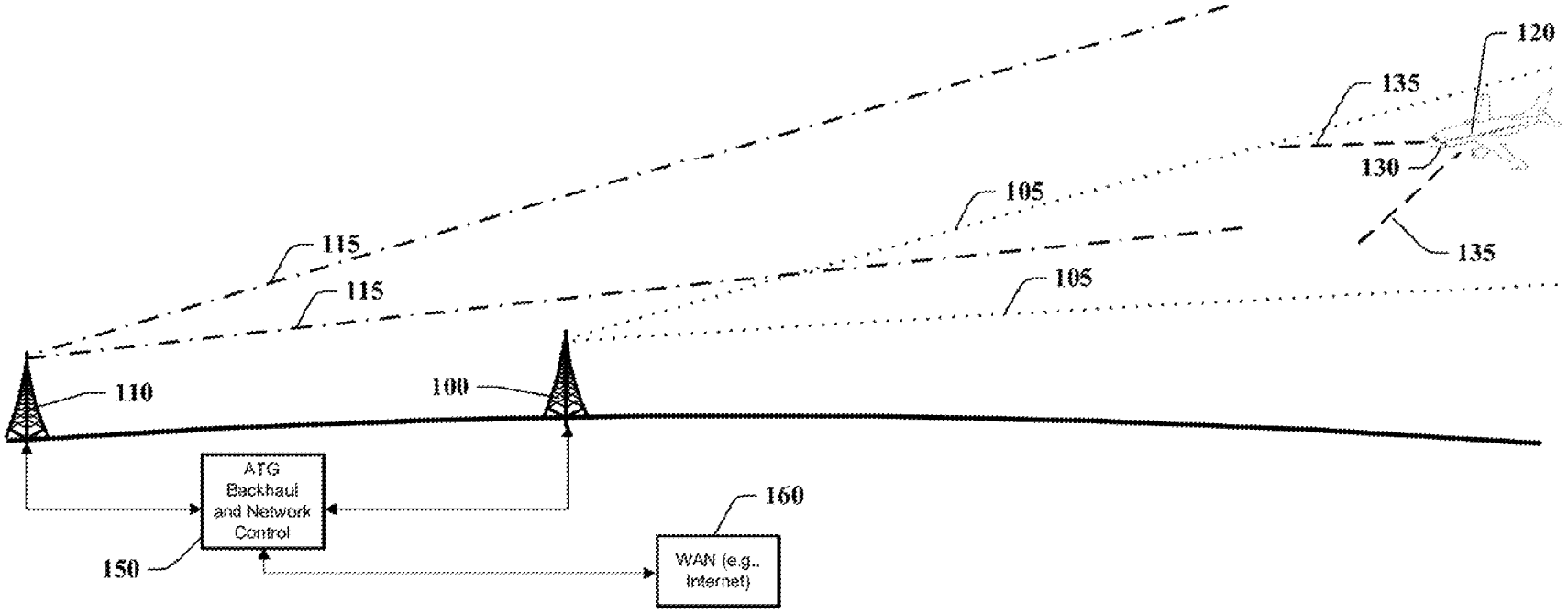
FIG. 1 illustrates a side view of a network topology of an ATG network employing aircraft with a directive antenna in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals may be used to refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments described herein provide architectures for improved air-to-ground (ATG) wireless communication performance via improved antenna design. In this regard, some example embodiments may provide for an antenna design that delivers improved gain (e.g., toward the horizon) in an omni-directional, but steerable structure. The improved gain toward the horizon may enable aircraft to engage in communications with potentially distant base stations on the ground. Accordingly, an ATG network may potentially be built with base stations that are much farther apart than the typical distance between base stations in a terrestrial network while employing directivity to steer beams from the aircraft toward the ground stations.

Conventional antennas are formed by embedding conductors of structured shapes within a surrounding medium. The surrounding medium can be air or other non-conducting (insulating) media. The resulting local fields and currents in response to the differently shaped material properties and alternating currents applied to the antenna input ports determine the direction and polarization of radiated fields as well as the observed frequency dependent impedance at the antenna port. A class of antennas that is used often is that of linear antennas such as straight monopole or dipole elements. These elements are often sized such that their length is approximately ½ or ¼ of the wavelength (λ) of the resonant frequency of the antenna, and as such they become resonant. At this resonance the input impedance is purely real and the reactive component vanishes. This is convenient as the antenna can be directly connected to a transmission line and the transmission line would not carry losses due to additional reactive fields or currents.

The geometry of vertically oriented linear antenna elements, and as such their radiating currents and fields, are generally independent of the azimuth angle of observation. Furthermore, the radiated or received field intensity (or directivity) of such elements is also independent of the azimuth angle. In other words, the radiation pattern is omni-directional (in azimuth) and has a characteristic radiation pattern in the elevation angle.

These principles can be used and slightly modified to take an otherwise omni-directional antenna element, and add directivity. For example, the well-known Yagi antenna places a directive element (i.e., a director) and a reflective element (i.e., a reflector) on either side of a driven element in order to create constructive (in phase) interference on the side of the director, and destructive interference (out of phase) on the side of the reflector. This improves the gain of the Yagi antenna in the direction of the director, and reduces the gain in the direction of the reflector to create directivity or a directional control over the antenna. However, the Yagi antenna generally fixes the location of the director and reflector, and therefore also fixes the direction of constructive interference and gain increase. As such, to change the direction of higher gain, it becomes necessary to physically reorient the antenna.

Although physically reorienting an antenna may be one way to achieve directionality, it is generally not a feasible option for an aviation antenna where size, weight and cost can be very limiting. Accordingly, some example embodiments provide an architecture that enables controls to be provided to an antenna assembly to allow directivity to be achieved around a full 360 degree sweep around the main driven element. The structures described herein may be useful in any ATG context, or also in other networks. However, an example embodiment will be described in relation to a particular ATG network that advantageously employs antennas that primarily look to the horizon in order to minimize interference and extend ranges of operation. This example network should therefore be appreciated as merely a non-limiting example of one network and one network architecture inside which example embodiments may be practiced.

Accordingly, for example, an ATG network may include a plurality of base stations on the ground having antenna structures configured to generate a wedge-shaped cell inside which directional beams may be focused. The wedge shaped cells may be spaced apart from each other and arranged to overlap each other in altitude bands to provide coverage over a wide area and up to the cruising altitudes of in-flight aircraft. The wedge shaped cells may therefore form overlapping wedges that extend out toward and just above the horizon. Thus, the size of the wedge shaped cells is characterized by increasing altitude band width (or increasing vertical span in altitude) as distance from the base station increases. Meanwhile, the in-flight aircraft may employ antennas that are capable of focusing toward the horizon and just below the horizon such that the aircraft generally communicate with distant base stations instead of base stations that may be immediately below or otherwise proximal (e.g., nearest) the aircraft. In fact, for example, an aircraft directly above a base station would instead be served by a more distant base station as the aircraft antennas focus near the horizon, and the base station antennas focus above the horizon. This leaves the aircraft essentially unaffected by the communication transmitters that may be immediately below the aircraft. Thus, for example, the same RF spectrum (e.g., WiFi), and even the same specific frequencies the aircraft is using to communicate with a distally located base station may be reused by terrestrial networks immediately below the aircraft. As a result, spectrum reuse can be practiced relative to terrestrial wireless communication networks and the ATG network and the ATG network may use a same band of frequency spectrum (e.g., the unlicensed band) as the terrestrial networks without interference.

In the ATG network, beamforming may be employed to steer or form directionally focused beams to the location of the airborne assets. This further facilitates interference mitigation and increases range. However, it generally also means that the aircraft (or assets thereon) should be tracked to continuously enable beamforming to be accurately conducted to serve the aircraft (or assets thereon).

FIG. 1 illustrates an example network architecture for providing ATG communication services between at least partially overlapping cells of the ATG network. FIG. 1 shows only two dimensions (e.g., an X direction in the horizontal plane and a Z direction in the vertical plane), however it should be appreciated that the wedge architecture of the ATG network may be structured to extend coverage also in directions into and out of the page (i.e., in the Y direction). Although FIG. 1 is not drawn to scale, it should be appreciated that the wedge shaped cells generated by the base stations for the ATG network may be configured to have a much longer horizontal component than vertical component. In this regard, the wedge shaped cells may have a horizontal range on the order of dozens to nearly or more than 100 miles. Meanwhile, the vertical component expands with distance from the base stations, but is in any case typically less than about 8 miles (e.g., about 45,000 ft).

As shown in FIG. 1, a first ATG base station 100 and a second ATG base station 110, which are examples of base stations employed in the ATG network as described above (e.g., employing wedge shaped cells) may be operating in a particular geographic area. The first ATG base station 100 may be deployed substantially in-line with the second ATG base station 110 along the X axis and may generate a first wedge shaped cell (defined between boundaries 105) that may be layered on top of a second wedge shaped cell (defined between boundaries 115) generated by the second ATG base station 110. When an in-flight aircraft 120 is exclusively in the first wedge shaped cell, the aircraft 120 (or wireless communication assets thereon) may communicate with the first ATG base station 100 using assigned RF spectrum (e.g., unlicensed spectrum) and when the aircraft 120 is exclusively in the second wedge shaped cell, the aircraft 120 (or wireless communication assets thereon) may communicate with the second ATG base station 110 using the assigned RF spectrum. The communication may be accomplished using beamforming to form or steer a beam toward the aircraft 120 within either the first or second wedge shaped cell based on knowledge of the location of the aircraft 120.

The aircraft 120 (or wireless communication assets thereon) may employ a radio and antenna assembly 130 configured to interface with the first and second ATG base stations 100 and 110 of the ATG network (and any other ATG base stations of the ATG network). The antenna assembly 130 may also be configured to be directed generally toward the horizon with steerable beams directed toward the first and second ATG base stations 100 and 110. In this regard, the antenna assembly 130 may be configured to generate a directive radiation pattern (defined between boundaries 135).

An area of overlap between the first wedge shaped cell and the second wedge shaped cell may provide the opportunity for handover of the in-flight aircraft 120 between the first ATG base station 100 and the second ATG base station 110, respectively. Beamforming may thus be used by each of the first and second base stations 100 and 110 to steer or form respective beams for conduct of the handover. Meanwhile, the antenna assembly 130 on the aircraft 120 may also be configured to form directive beams toward the first or second base stations 100 and 110 to ensure connectivity is maintained as the aircraft 120 moves and changes its relative location with respect to either of the first or second base stations 100 and 110. Accordingly, uninterrupted handover of receivers on the in-flight aircraft 120 may be provided while passing between coverage areas of base stations of the ATG network having overlapping coverage areas as described herein.

In an example embodiment, the ATG network may include ATG backhaul and network control components 150 that may be operably coupled to the first and second ATG base stations 100 and 110. The ATG backhaul and network control components 150 may generally control allocation of the assigned RF spectrum and system resources of the ATG network. The ATG backhaul and network control components 150 may also provide routing and control services to enable the aircraft 120 and any UEs and other wireless communication devices thereon (i.e., wireless communication assets on the aircraft 120) to communicate with each other and/or with a wide area network (WAN) 160 such as the Internet.

Given the curvature of the earth and the distances between base stations of the ATG network may be enhanced. Additionally, the base stations of the ATG network and the antenna assembly 130 of the aircraft 120 may be configured to communicate with each other using relatively small, directed beams that are generated using beamforming techniques, as mentioned above. The beamforming techniques employed may include the generation of relatively narrow and focused beams. Thus, the generation of side lobes (e.g., radiation emissions in directions other than in the direction of the main beam) that may cause interference may be reduced. However, using these relatively narrow and focused beams generally requires some accuracy with respect to aiming or selection of such beams in order to make the beams locate and track the position of the aircraft 120.

Figure 2:
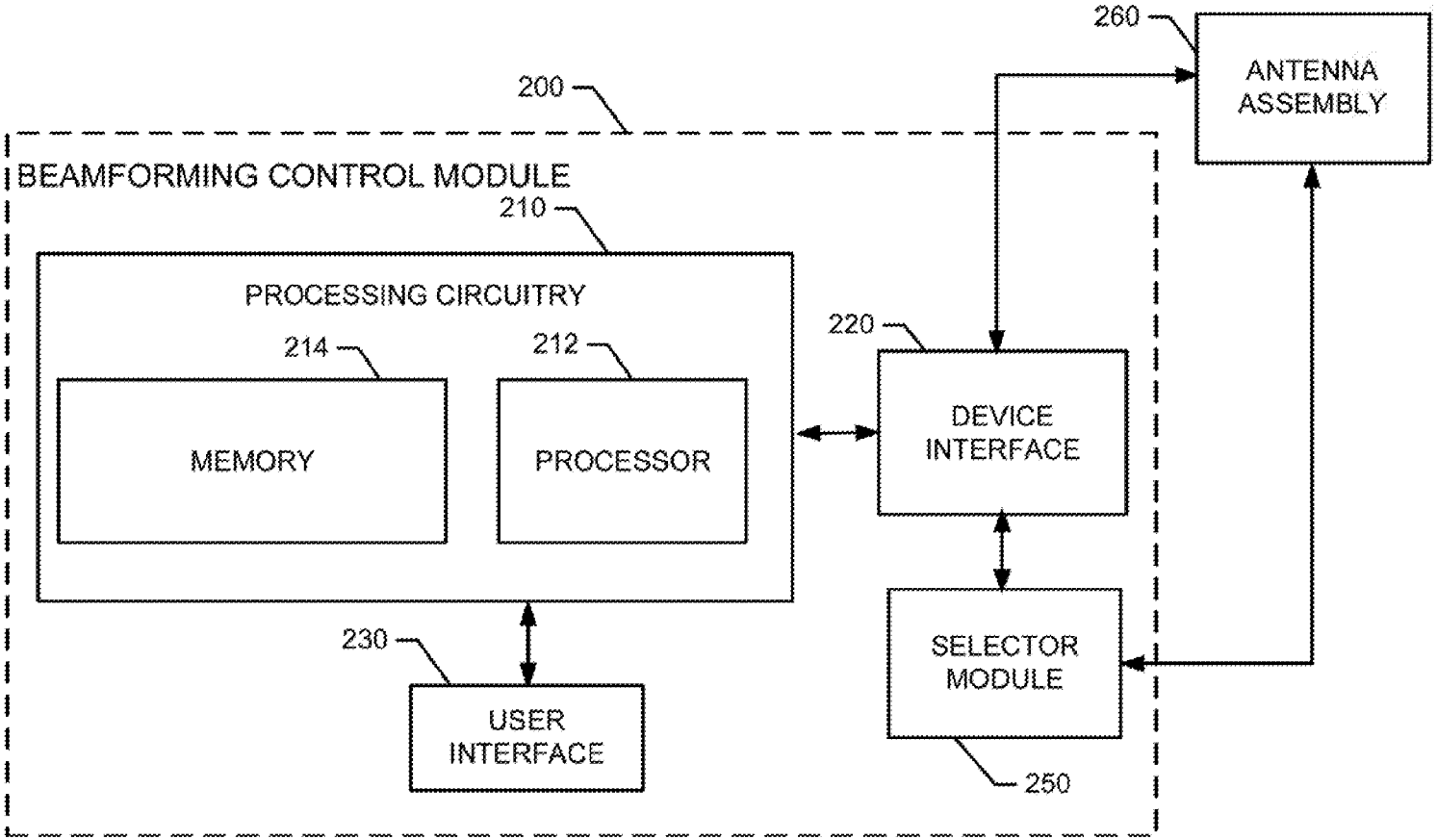
FIG. 2 illustrates a functional block diagram of a beam-forming control module of an example embodiment.

In an example embodiment, beamforming control modules may be employed at radios or radio control circuitry of either or both of the aircraft 120 and the base stations of the ATG network. These beamforming control modules may use location information provided by components of the respective devices to direct beamforming to the location of the aircraft 120 or the base stations, respectively. FIG. 2 illustrates a block diagram of a beamforming control module 200 in accordance with an example embodiment. As shown in FIG. 2, the beamforming control module 200 may include processing circuitry 210 configured to manage the use of aircraft location/position information for conducting beamforming as described herein.

The processing circuitry 210 may be configured to perform data processing, control function execution and/or other processing and management services according to an example embodiment of the present invention. In some embodiments, the processing circuitry 210 may be embodied as a chip or chip set. In other words, the processing circuitry 210 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 210 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 210 may include one or more instances of a processor 212 and memory 214 that may be in communication with or otherwise control a device interface 220 and, in some cases, a user interface 230 (which may be optional). As such, the processing circuitry 210 may be embodied as a circuit chip (e.g., an integrated circuit chip) configured (e.g., with hardware, software or a combination of hardware and software) to perform operations described herein. In some embodiments, the processing circuitry 210 may be embodied as a portion of a computer located in the core of the ATG network, or at a central location accessible to the ATG network. However, in other embodiments (e.g., when the beamforming control module 200 is located on the aircraft 120), the processing circuitry 210 may be part of the electronics of the aircraft 120 or a separate instance of circuitry otherwise disposed at the aircraft 120. In some embodiments, the processing circuitry 210 may communicate with various components, entities and/or sensors of the aircraft 120, or of the network to receive information used to determine where to point a beam. Thus, for example, the processing circuitry 210 may communicate with a sensor network of the aircraft 120, or other entities of the network to make determinations regarding where to point antenna beams.

The device interface 220 may include one or more interface mechanisms for enabling communication with other devices (e.g., base stations, modules, entities, sensors and/or other components of the aircraft 120 or the ATG network). In some cases, the device interface 220 may be any means such as a device or circuitry embodied in either hardware, or a combination of hardware and software that is configured to receive and/or transmit data from/to aircraft, base stations, modules, entities, sensors and/or other components of the ATG network that are in communication with the processing circuitry 210.

The processor 212 may be embodied in a number of different ways. For example, the processor 212 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 212 may be configured to execute instructions stored in the memory 214 or otherwise accessible to the processor 212. As such, whether configured by hardware or by a combination of hardware and software, the processor 212 may represent an entity (e.g., physically embodied in circuitry—in the form of processing circuitry 210) capable of performing operations according to embodiments of the present invention while configured accordingly. Thus, for example, when the processor 212 is embodied as an ASIC, FPGA or the like, the processor 212 may be specifically configured hardware for conducting the operations described herein. Alternatively, as another example, when the processor 212 is embodied as an executor of software instructions, the instructions may specifically configure the processor 212 to perform the operations described herein.

In an example embodiment, the processor 212 (or the processing circuitry 210) may be embodied as, include or otherwise control the operation of the beamforming control module 200 based on inputs received by the processing circuitry 210 indicative of the position/location of the aircraft 120 or base stations (and/or future positions of the aircraft 120 or base stations at a given time). As such, in some embodiments, the processor 212 (or the processing circuitry 210) may be said to cause each of the operations described in connection with the beamforming control module 200 in relation to processing location information for beam forming decisions based on execution of instructions or algorithms configuring the processor 212 (or processing circuitry 210) accordingly. In particular, the instructions may include instructions for determining that it is desirable to initiate formation of a beam in a particular direction and control of various components configured to control formation of the same.

In an exemplary embodiment, the memory 214 may include one or more non-transitory memory devices such as, for example, volatile and/or non-volatile memory that may be either fixed or removable. The memory 214 may be configured to store information, data, applications, instructions or the like for enabling the processing circuitry 210 to carry out various functions in accordance with exemplary embodiments of the present invention. For example, the memory 214 could be configured to buffer input data for processing by the processor 212. Additionally or alternatively, the memory 214 could be configured to store instructions for execution by the processor 212. As yet another alternative, the memory 214 may include one or more databases that may store a variety of data sets responsive to input from sensors and network components. Among the contents of the memory 214, applications and/or instructions may be stored for execution by the processor 212 in order to carry out the functionality associated with each respective application/instruction. In some cases, the applications may include instructions for directing formation of a steerable beam (or steering of a formed beam) in a particular direction as described herein. In an example embodiment, the memory 214 may store static and/or dynamic position information indicative of a location of the aircraft 120 or base station (e.g., now and in the future) for use in beamforming. The memory 214 may also or alternatively store parameters or other criteria that, when met, may trigger the execution of beam formation/steering and/or the manipulation of various components that are used for the same.

In an example embodiment, the beamforming control module 200 may include or otherwise control a selector module 250. As such, in some cases, the processing circuitry 210 may also control the selector module 250. In an example embodiment, the selector module 250 may operate as a programmed module of the processing circuitry 210, but in other cases, the selector module 250 may be a separate module (e.g., a separate ASIC or FPGA) having its own processing circuitry (which may be similar in form and/or function to the processing circuitry 210) configured to operate as described herein. In particular, the selector module 250 may be configured to operate switch assemblies as described herein for selection of specific antenna elements to use as parasitic elements.

The selector module 250 may be configured to interface with an antenna assembly 260 (which may be an example of antenna assembly 130 of the aircraft 120, or an antenna of a base station). In particular, the selector module 250 may interface with the antenna assembly 260 to select specific elements of the antenna assembly 260 that are to be utilized in connection with beam formation to form or steer a beam. In this regard, for example, the antenna assembly 260 may include a number of antenna elements that can be controlled by the selector module 250 to effectively control the direction in which the antenna assembly 260 forms a receive or transmit beam. Accordingly, the structure of the antenna assembly 260 and the antenna elements therein may influence the operational requirements on the selector module 250.

Of note, although the example of FIG. 2 illustrates the selector module 250 as a portion of the beamforming control module 200, the selector module 250 could instead be separate from the beamforming control module 200. Moreover, in some cases, the selector module 250 may be a portion of the antenna assembly 260, or disposed between the beamforming control module 200 and the antenna assembly 260. In any case, the selector module 250 may be operably coupled to each of the beamforming control module 200 and the antenna assembly 260 to enable radio control signals to be used to conduct switching for the selection of parasitic elements to influence directivity of a resulting antenna. By changing the selection of parasitic elements beam steering can be accomplished as described herein.

Figure 3:
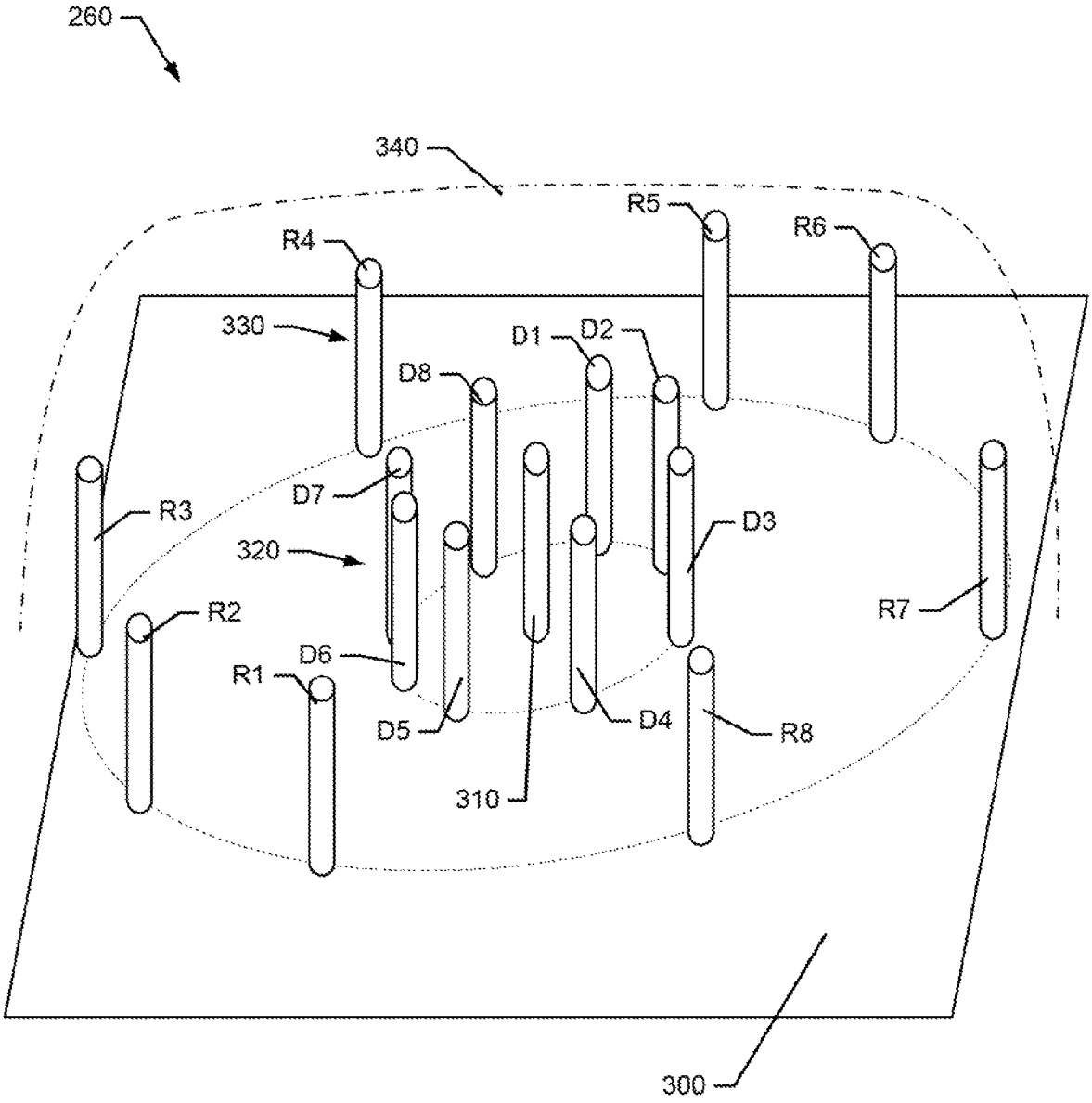
FIG. 3 illustrates a perspective view of antenna elements of an antenna assembly in accordance with an example embodiment.

FIG. 3 illustrates a plan view of an antenna assembly 260 of an example embodiment to facilitate an explanation of how the selector module 250 of an example embodiment may function. In this regard, the antenna assembly 260 may for formed at or otherwise operably coupled to a ground plane 300. The ground plane 300 could be a surface of an aircraft (e.g., aircraft 120) or a surface of some other media that may be attached to an aircraft or a base station. A plurality of monopole antenna elements may be disposed on the ground plane 300 in a particular pattern as shown in FIG. 3. In this regard, for example, a single driven element 310 may be provided at or near a center of the antenna assembly 260. The driven element 310 may extend substantially perpendicularly away from the ground plane 300 and may be connected to radio circuitry configured for transmit/receive functions to provide signals for transmission to, or receive signals from reception at, the driven element 310. In some cases, the driven element 310 may have a length selected to be about a quarter wavelength for the frequency of operation of the radio circuitry.

The driven element 310 may be surrounded by a first set of antenna elements 320 and a second set of antenna elements 330 that are disposed spaced apart from the driven element 310 at fixed intervals. In this regard, for example, the first set of antenna elements 320 may be disposed at a first distance from the driven element 310, and the second set of antenna elements 330 may be disposed at a second distance from the driven element 310. The first distance may be smaller than the second distance, and each may define a radius for a corresponding circle formed with the driven element 310 at a center thereof. All of the antenna elements may therefore be disposed at a respective one of the circles, and the antenna elements may each be equidistant from adjacent elements on the same circle. Moreover, each one of antenna elements of the first set of antenna elements 320 is radially aligned with a corresponding one of the antenna elements of the second set of antenna elements 330.

In an example embodiment, a radome 340 may be disposed over all of the antenna elements of the first and second sets of antenna elements 320 and 330. The radome 340 may be used to improve aerodynamic characteristics of the antenna assembly 260 for use on the aircraft 120. However, even if used on the ground, the radome 240 may generally protect the antenna elements of the first and second sets of antenna elements 320 and 330.

In an example embodiment, each of the first and second sets of antenna elements 320 and 330 may include eight antenna elements. Accordingly, each one of the antenna elements in each of the first and second sets of antenna elements 320 and 330 may be positioned 45 degrees from each adjacent antenna element in the same set. As such, for example, if a first antenna element (D1) of the first set of antenna elements 320 may be positioned at a reference position of zero degrees, then a second (D2) antenna element of the first set of antenna elements 320 would be positioned at 45 degrees and a third (D3) antenna element of the first set of antenna elements 320 would be positioned at 90 degrees. This pattern may continue such that the fourth (D4) antenna element is at 135 degrees, the fifth (D5) antenna element is at 180 degrees, the sixth (D6) antenna element is at 225 degrees, the seventh (D7) antenna element is at 270 degrees, and the eighth (D8) antenna element is at 315 degrees. For reasons discussed in greater detail below, although the second set of antenna elements 330 is radially aligned with the first set of antenna elements 320, the numbering of the specific elements will be 180 degrees out of phase with each other so that the first (R1) antenna element of the second set of antenna elements 330 is disposed opposite the driven element 310 with respect to D1 of the first set of antenna elements 320. Thus, the first antenna element (R1) of the second set of antenna elements 330 may be positioned at 180 degrees (to align with D1 on the opposite side of the driven element 310), the second (R2) antenna element of the second set of antenna elements 330 would be positioned at 225 degrees (to align with D2 on the opposite side of the driven element 310) and the third (R3) antenna element of the second set of antenna elements 330 would be positioned at 270 degrees (to align with D3 on the opposite side of the driven element 310). This pattern may continue such that the fourth (R4) antenna element is at 315 degrees, the fifth (R5) antenna element is at 0 degrees, the sixth (R6) antenna element is at 45 degrees, the seventh (R7) antenna element is at 90 degrees, and the eighth (R8) antenna element is at 135 degrees.

The alignment described above may enable the selector module 250 to select a combination of R1 and D1 to steer a beam centered at the reference point of 0 degrees, select a combination of R2 and D2 to steer a beam centered at the reference point of 45 degrees, select a combination of R3 and D3 to steer a beam centered at the reference point of 90 degrees, and select a combination of R4 and D4 to steer a beam centered at the reference point of 135 degrees. Similarly, the selector module 250 may be configured to select a combination of R5 and D5 to steer a beam centered at the reference point of 180 degrees, select a combination of R6 and D6 to steer a beam centered at the reference point of 225 degrees, select a combination of R7 and D7 to steer a beam centered at the reference point of 270 degrees, and select a combination of R8 and D8 to steer a beam centered at the reference point of 315 degrees. The manner of this selection will be described in greater detail below in reference to FIG. 4.

Figure 4:
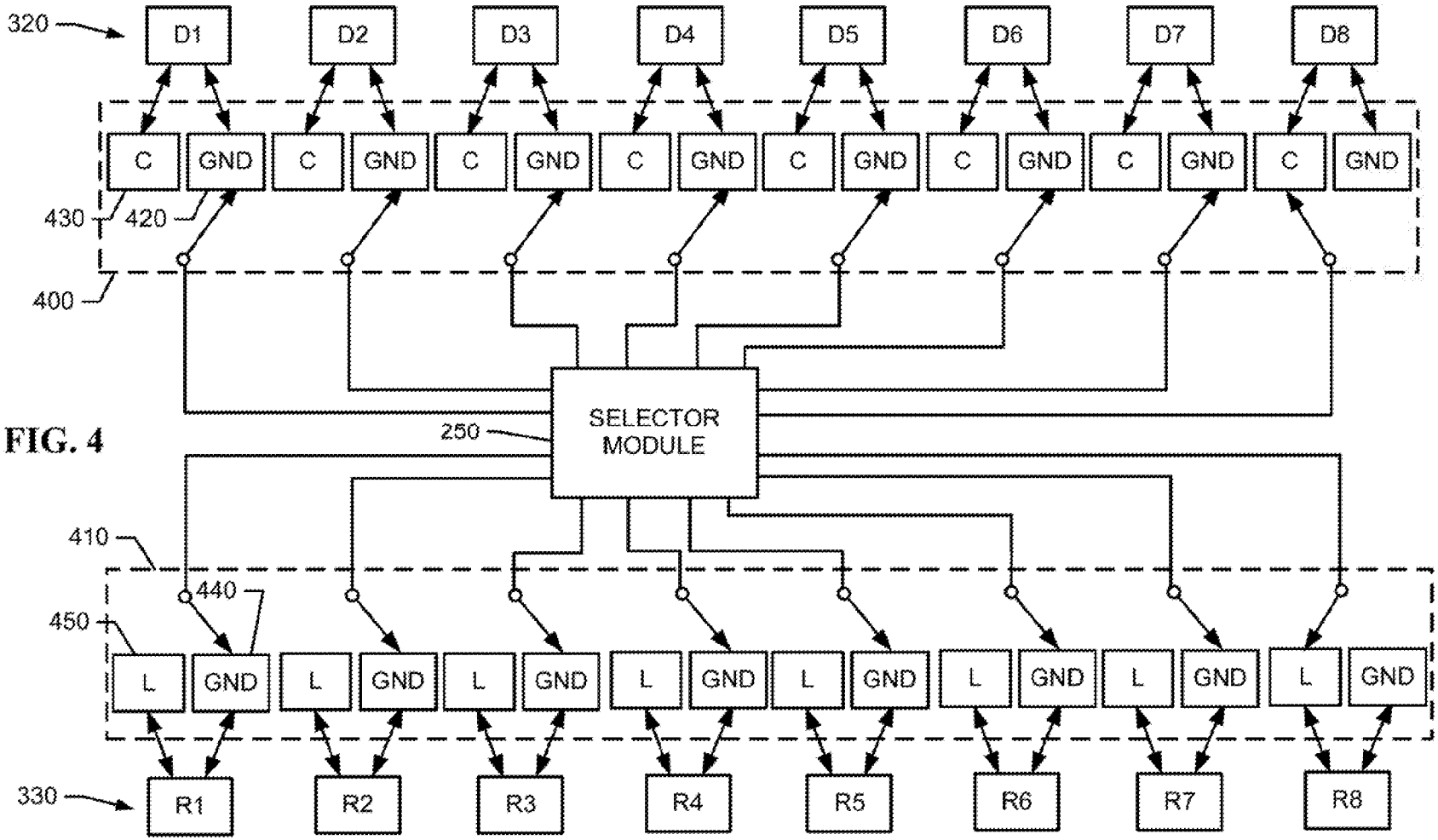
FIG. 4 illustrates a selector module and corresponding switching assemblies in accordance with an example embodiment.

FIG. 4 illustrates one example architecture for circuitry by which the selector module 250 may implement selection of any of the combinations described above. In this regard, for example, the selector module 250 may be configured to include or operate a first switch assembly 400 for the antenna elements (D1 to D8) of the first set of antenna elements 320, and a second switch assembly 410 for the antenna elements (R1 to R8) of the second set of antenna elements 330. The first switch assembly 400 may include switches that are controllable by the selector module 250 to either ground out the corresponding antenna element or add capacitance in series therewith to effectively shorten the corresponding antenna element. As such, the selector module 250 may be configured to utilize the first switch assembly 400 to connect all except for a selected one of the antenna elements (D1 to D8) of the first set of antenna elements 320 to a ground terminal 420, and to connect the selected one to a capacitor 430. The connection of the capacitor 430 in series with the selected one will effectively shorten the length of the selected one of the antenna elements (D1 to D8) of the first set of antenna elements 320.

The second switch assembly 410 may include switches that are controllable by the selector module 250 to either ground out the corresponding antenna element or add inductance in series therewith to effectively lengthen the corresponding antenna element. As such, the selector module 250 may be configured to utilize the second switch assembly 410 to connect all except for a selected one of the antenna elements (R1 to R8) of the second set of antenna elements 330 to a ground terminal 440, and to connect the selected one to an inductor 450. The connection of the inductor 450 in series with the selected one will effectively lengthen the selected one of the antenna elements (R1 to R8) of the first set of antenna elements 320.

Based on the descriptions provided above, it can be appreciated that when the selector module 250 selects a pair of individual antenna elements (i.e., one from each of the first set of antenna elements 320 and the second set of antenna elements 330), the result is that all other antenna elements are grounded (e.g., to the ground plane 300) so that the driven element 310 remains and has a length of about a quarter wavelength, while the selected one of the antenna elements (D1 to D8) of the first set of antenna elements 320 is closer to the driven element 310 and shorter than the driven element 310, and the selected one of the antenna elements (R1 to R8) of the second set of antenna elements 330 is farther away from the driven element 310 and longer than the driven element 310. The result is effectively a Yagi antenna oriented in the direction of the selected one of the antenna elements (D1 to D8) of the first set of antenna elements 320.

In this regard, the operation of a Yagi antenna is well known to those of skill in the art. In particular, a typical Yagi configuration may employ a driven element that lies directly between a reflector and a director. The director may, in some cases, be about half as far away from the driven element as the reflector, and spacing between elements can generally range from about 1/10 to about 1/4 of a wavelength depending on specific design objectives. Accordingly, by employing the selector module 250 for the antenna assembly 260 of FIG. 3, it is possible to select eight different pointing directions with eight possible selection options. However, it should be appreciated that more or fewer options may be presented in other embodiments by adding more or fewer total antenna elements.

In an example embodiment in which the antenna assembly 260 is configured to operate in the unlicensed band (e.g., 2.4 GHz), the lengths of the elements may be less than 1.5 inches. The reflectors (R1 to R8) may be disposed about 1/4 wavelength (or less than about 1.5 inches) from the driven element 310, and the directors (D1 to D8) may be disposed half that distance (or less than about 0.75 inches) from the driven element 310. Thus, the height of the radome 340 off the ground plane 300 may be less than 2 inches. The radius of the second set of antenna elements 330 may be about 3 inches or less. Thus, the diameter of the radome 340 may also be less than about 3.5 inches. However, other dimensions are possible for other frequencies of operation. For example, a 5 GHz signal may be used with elements having about 1/2 of the dimensions noted above.

Figure 5:
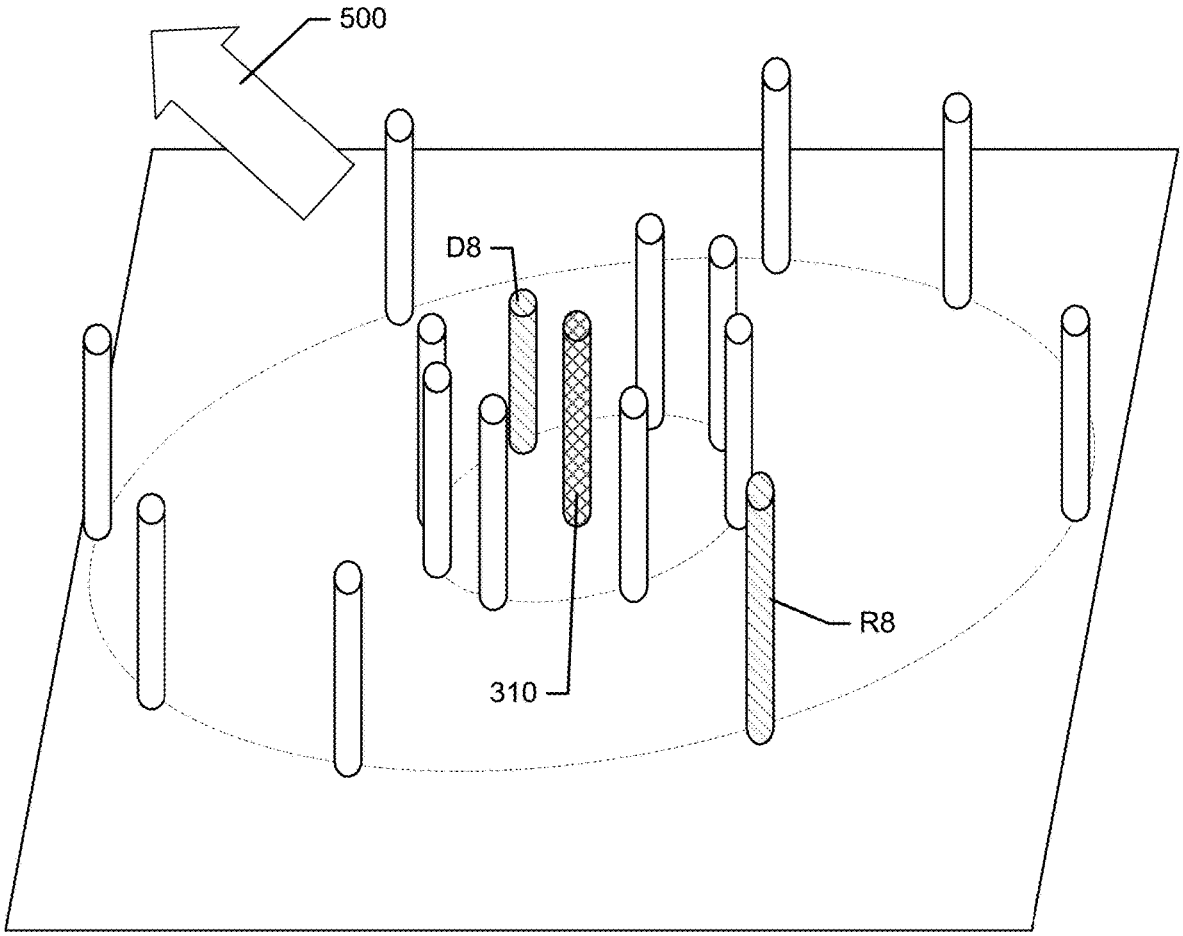
FIG. 5 illustrates the antenna assembly of FIG. 3 with individual director and reflector elements selected for beam formation in accordance with an example embodiment.
Figure 6:
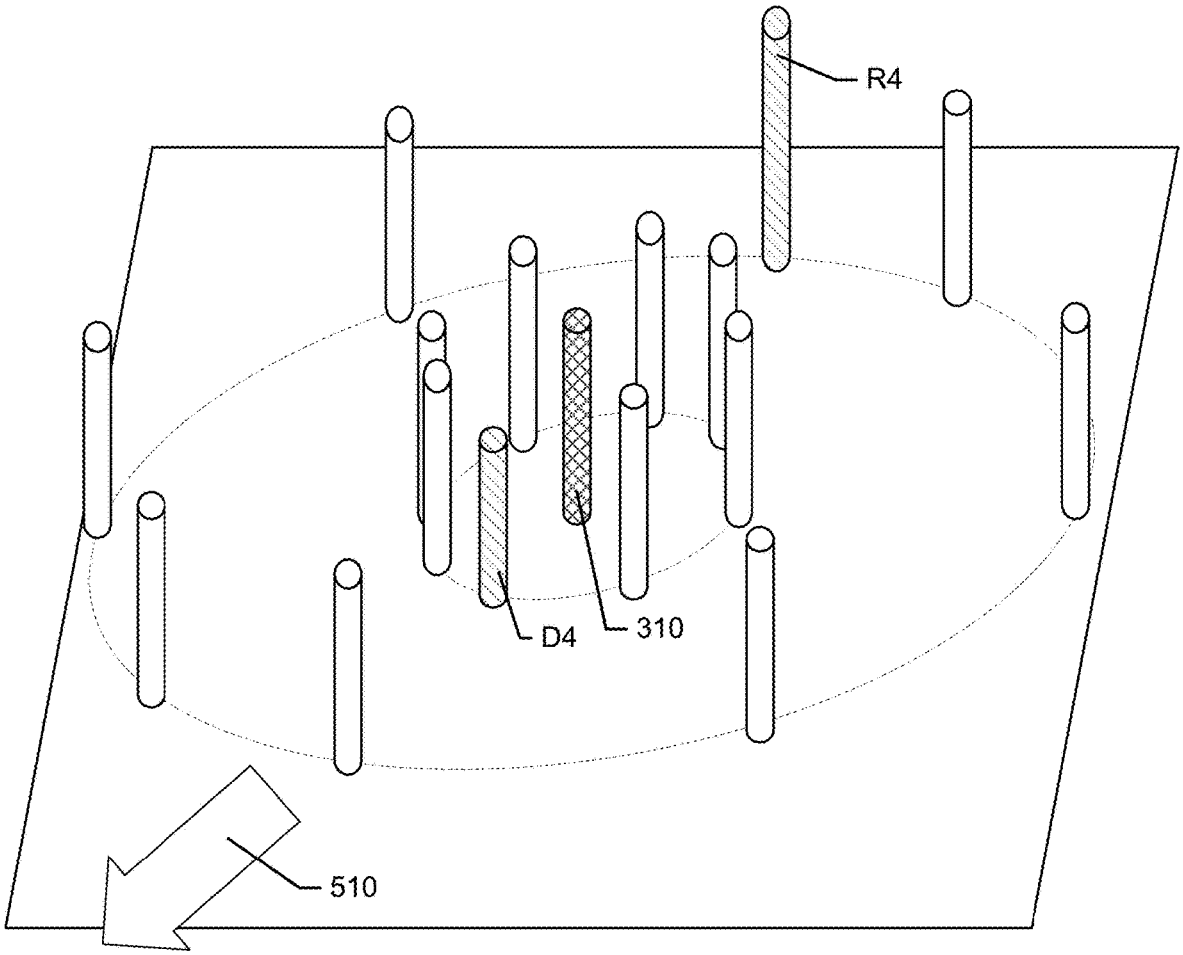
FIG. 6 illustrates the antenna assembly of FIG. 3 with individual director and reflector elements selected for an alternative beam formation in accordance with an example embodiment.

In the example of FIGS. 4, D8 and R8 are selected for shortening and lengthening, respectively. Meanwhile, D1 to D7 and R1 to R7 are shorted out, and effectively invisible. As a result, and as shown in FIG. 5, the antenna assembly 260 generates a beam (indicated by arrow 500) that is generally oriented to 315 degrees relative. Meanwhile, if D4 and R4 were instead selected, then a beam (as indicated by arrow 510) oriented at 180 relative may be formed, as shown in FIG. 6. Of note, each of the beams may have a substantially fixed and similar elevation that extends substantially away from the antenna assembly 260 perpendicular to the direction of extension of the elements. The ground plane 300 will limit the beam width elevation, so the beam width may extend substantially away from the ground plane 300 by some amount. In an example embodiment, the width of the beam in altitude or elevation may be about 70 degrees, as measured at the half power points (−3 dB) from the main lobe that is oriented in the direction of the arrows 500 and 510. Meanwhile, the width of the beam in azimuth may be about 100 degrees, as measured at the half power points (−3 dB). Although the beam width in elevation remains fixed (e.g., at about 70 degrees) and there is no steering in elevation, the beams can be steered fully 360 degrees around the driven element 310 (in the manner described above) in azimuth.

Accordingly, example embodiments may achieve a full 360 degree coverage (in transmit and receive mode) for beam steering in azimuth using only a single driven element. No switches are therefore required in the signal path, since the only switches employed are instead merely used to generate passive parasitic effects that are controllable via switching lines (e.g., via the first and second switch assemblies 400 and 410). Some example embodiments, while operating at unlicensed band frequencies (e.g., 2.4 GHz), may achieve a peak gain of about 10 dBi, with minimum gain over the width of the beam of about 7 to 8 dBi. Side-lobe characteristic patterns from the peak have been measured at −13 dB in azimuth and −7 dB in elevation.

When employed with a relatively large ground plane (e.g., at least four feet in diameter), about half of the vertical beam elevation may be lost, thereby reducing beamwidth in vertical elevation to about 37 degrees. Thus, for example, if the ground plane 300 is formed at a surface of the underneath portion of a wing or fuselage of the aircraft 120, the vertical beam elevation may essentially point toward within 10 degrees of the horizon with vertical polarization. As noted above, this may reduce interference with transmitters immediately below the aircraft 120, and may therefore be advantageous within an ATG network context. Moreover, example embodiments may be practiced without any requirement for employment of a remote radio head due to the fact that simple switching controls may be employed from the radio circuitry (e.g., in the form of the beamforming control module 200 and/or the selector module 250).

In accordance with an example embodiment, a directive antenna assembly may be provided. The antenna assembly may include a driven element, a first set of antenna elements disposed a first distance from the driven element such that each element of the first set of antenna elements is equidistant from adjacent elements of the first set of antenna elements, and a second set of antenna elements disposed a second distance from the driven element such that each element of the second set of antenna elements is equidistant from adjacent elements of the second set of antenna elements. The second distance may be larger than the first distance. The antenna assembly may include or be operably coupled to a selector module configured to select one element of the first set of antenna elements as a selected director, and select one element of the second set of antenna elements as a selected reflector by effectively shortening a length of the selected director and effectively lengthening the selected reflector.

The antenna assembly described above may include additional features, modifications, augmentations and/or the like in some cases. Such features, modifications, or augmentations may be optional, and may be combined in any order or combination. For example, in some cases, a number of the first set of antenna elements (e.g., eight) may be equal to a number of the second set of antenna elements (e.g., eight). In an example embodiment, the first set of antenna elements may each be in radial alignment with corresponding ones of the second set of antenna elements. In some cases, the selected director and the selected reflector may be on opposite sides of the driven element. In an example embodiment, the antenna assembly may further include a ground plane at which the driven element, the first set of antenna elements and the second set of antenna elements are mounted such that the driven element, the first set of antenna elements and the second set of antenna elements each extend substantially perpendicularly away from the ground plane and parallel to each other. In some cases, the selected director may be effectively shortened by adding a capacitor in series therewith, and the selected reflector may be effectively lengthened by adding an inductor in series therewith. In an example embodiment, the selector module grounds out all of the first set of antenna elements except for the selected director, and grounds out all of the second set of antenna elements except for the selected reflector. In some cases, the selector module may include a first switch assembly configured to connect the selected director to the capacitor and electrically connect the all of the first set of antenna elements except for the selected director to the ground plane, and the selector module may include a second switch assembly configured to connect the selected reflector to the inductor and electrically connect the all of the second set of antenna elements except for the selected reflector to the ground plane. In an example embodiment, the ground plane may be formed at the physical interface of an aircraft wing or fuselage (e.g., at an underside of the wing or fuselage). In some cases, a radome may house the driven element, the first set of antenna elements and the second set of antenna elements. The radome may be operably coupled to the aircraft wing or fuselage. In an example embodiment, the radome may have a diameter of less than about 3.5 inches and a height of less than about 2 inches, and the ground plane may be at least 4 feet in diameter. In some cases, responsive to operation of the selector module, the antenna assembly may be configurable to steer a directive beam 360 degrees in azimuth with a fixed beamwidth in elevation. In an example embodiment, the antenna assembly may be configured to be disposed on an aircraft, and the fixed beamwidth in elevation may be directed toward the horizon.

Figure 7:
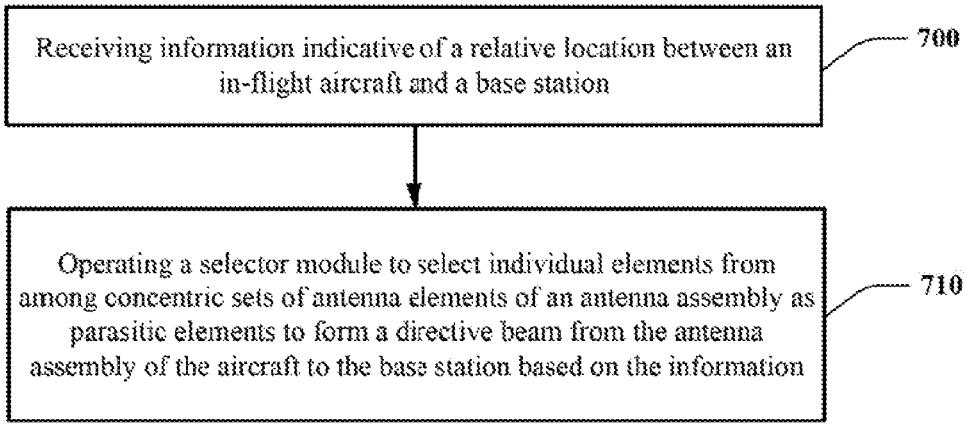
FIG. 7 illustrates a block diagram of a method of forming a directive beam in accordance with an example embodiment.

FIG. 7 illustrates a block diagram of one method that may be associated with an example embodiment as described above. From a technical perspective, the processing circuitry 210 described above may be used to support some or all of the operations described in FIG. 7. As such, FIG. 7 is a flowchart of a method and program product according to an example embodiment of the invention. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device of a device (e.g., the beamforming control module 200, and/or the like) and executed by a processor in the device. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the invention, as shown in FIG. 7, may include receiving information indicative of a relative location between an in-flight aircraft and a base station at operation 700. The method may further include operating a selector module to select individual elements from among concentric sets of antenna elements of an antenna assembly as parasitic elements to form a directive beam from the antenna assembly of the aircraft to the base station based on the information at operation 710. The method described above in reference to FIG. 7 may utilize the selector module described above to accomplish operation 710.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An antenna assembly comprising:

a driven element;

a first set of antenna elements disposed a first distance from the driven element such that each element of the first set of antenna elements is equidistant from adjacent elements of the first set of antenna elements; and a second set of antenna elements disposed a second distance from the driven element such that each element of the second set of antenna elements is equidistant from adjacent elements of the second set of antenna elements, the second distance being larger than the first distance, wherein the antenna assembly includes or is operably coupled to a selector module configured to generate a beam by selecting only one element of the first set of antenna elements as a selected director, and selecting only one element of the second set of antenna elements as a selected reflector by effectively shortening a length of the selected director and effectively lengthening the selected reflector.

2. The antenna assembly of claim 1, wherein a number of the first set of antenna elements is equal to a number of the second set of antenna elements.

3. The antenna assembly of claim 2, wherein the first set of antenna elements are each in radial alignment with corresponding ones of the second set of antenna elements.

4. The antenna assembly of claim 3, wherein the selected director and the selected reflector are disposed on opposite sides of the driven element.

5. The antenna assembly of claim 1, further comprising a ground plane at which the driven element, the first set of antenna elements and the second set of antenna elements are mounted such that the driven element, the first set of antenna elements and the second set of antenna elements each extend substantially perpendicularly away from the ground plane and parallel to each other.

6. The antenna assembly of claim 5, wherein the selected director is effectively shortened by adding a capacitor in series therewith, and the selected reflector is effectively lengthened by adding an inductor in series therewith.

7. The antenna assembly of claim 6, wherein the selector module grounds out all of the first set of antenna elements except for the selected director, and grounds out all of the second set of antenna elements except for the selected reflector.

8. The antenna assembly of claim 7, wherein the selector module comprises a first switch assembly configured to connect the selected director to the capacitor and electrically connect the all of the first set of antenna elements except for the selected director to the ground plane, and wherein the selector module comprises a second switch assembly configured to connect the selected reflector to the inductor and electrically connect the all of the second set of antenna elements except for the selected reflector to the ground plane.

9. The antenna assembly of claim 5, wherein the ground plane is formed at a physical interface of an aircraft wing or fuselage.

10. The antenna assembly of claim 9, wherein a radome houses the driven element, the first set of antenna elements and the second set of antenna elements, the radome being operably coupled to the aircraft wing or fuselage.

11. The antenna assembly of claim 10, wherein the radome has a diameter of less than about 3.5 inches and a height of less than about 2 inches, and wherein the ground plane is at least 4 feet in diameter.

12. The antenna assembly of claim 1, wherein, responsive to operation of the selector module, the antenna assembly is configurable to steer a directive beam 360 degrees in azimuth with a fixed beamwidth in elevation.

13. The antenna assembly of claim 12, wherein the antenna assembly is configured to be disposed on an aircraft, and wherein the fixed beamwidth in elevation is directed toward the horizon.

14. A selector module for control of an antenna assembly comprising a driven element, a first set of antenna elements disposed a first distance from the driven element such that each element of the first set of antenna elements is equidistant from adjacent elements of the first set of antenna elements, and a second set of antenna elements disposed a second distance from the driven element such that each element of the second set of antenna elements is equidistant from adjacent elements of the second set of antenna elements, the second distance being larger than the first distance, the selector module comprising:

a first switch assembly operably coupled to the first set of antenna elements to select only one element of the first set of antenna elements as a selected director and to effectively shorten a length of the selected director to form a beam, and a second switch assembly operably coupled to the second set of antenna elements to select only one element of the second set of antenna elements as a selected reflector and to effectively lengthen the selected reflector to form the beam.

15. The selector module of claim 14, wherein the antenna assembly further comprises a ground plane at which the driven element, the first set of antenna elements and the second set of antenna elements are mounted such that the driven element, the first set of antenna elements and the second set of antenna elements each extend substantially perpendicularly away from the ground plane and parallel to each other.

16. The selector module of claim 15, wherein the selected director is effectively shortened by adding a capacitor in series therewith, and the selected reflector is effectively lengthened by adding an inductor in series therewith.

17. The selector module of claim 16, wherein the selector module is configured to ground out all of the first set of antenna elements except for the selected director, and ground out all of the second set of antenna elements except for the selected reflector.

18. The selector module of claim 17, wherein the first switch assembly is configured to connect the selected director to the capacitor and electrically connect the all of the first set of antenna elements except for the selected director to the ground plane, and wherein the second switch assembly is configured to connect the selected reflector to the inductor and electrically connect the all of the second set of antenna elements except for the selected reflector to the ground plane.

19. The selector module of claim 15, wherein the driven element is not connected to the first switching assembly or the second switching assembly such that no switches are provided in a signal path of the driven element.

20. A method comprising receiving information indicative of a relative location between an in-flight aircraft and a base station; and operating a selector module to select individual elements from among concentric sets of antenna elements of an antenna assembly as parasitic elements to form a directive beam from the antenna assembly of the in-flight aircraft to the base station based on the information, wherein the concentric sets of antenna elements include a first set of antenna elements disposed a first distance from a driven element such that each element of the first set of antenna elements is equidistant from adjacent elements of the first set of antenna elements, and a second set of antenna elements disposed a second distance from the driven element such that each element of the second set of antenna elements is equidistant from adjacent elements of the second set of antenna elements, the second distance being larger than the first distance, wherein the directive beam is formed by controlling the selector module to select only one element of the first set of antenna elements as a selected director, and select only one element of the second set of antenna elements as a selected reflector by effectively shortening a length of the selected director and effectively lengthening the selected reflector.

* * * * *